United States Patent [19]

Remington

[11] 4,051,272

[45] Sept. 27, 1977

[54] LOW-TEMPERATURE THERMIONIC EMITTER

[75] Inventor: Richard W. Remington, San Carlos, Calif.

[73] Assignee: Electron Emission Systems, Tucson, Ariz.

[21] Appl. No.: 586,592

[22] Filed: June 13, 1975

Related U.S. Application Data

[63] Continuation of Ser. No. 129,443, March 30, 1971, abandoned.

[51] Int. Cl.[2] ..... B05D 5/12

[52] U.S. Cl. ..... 427/54; 427/77; 427/226; 427/228; 427/385 R; 427/388 R

[58] Field of Search ..... 427/77, 385, 388, 126, 427/54, 226, 228

[56] References Cited

U.S. PATENT DOCUMENTS

| | | | |
|---|---|---|---|
| 2,830,917 | 4/1958 | Kern | 428/632 |
| 2,895,854 | 7/1959 | LaRocque | 29/25.15 |
| 2,985,548 | 5/1961 | Blickwedel et al. | 427/77 |
| 3,222,173 | 12/1965 | Belko, Jr. et al. | 96/35 |
| 3,474,718 | 10/1969 | Guthrie et al. | 96/34 |
| 3,597,271 | 8/1971 | Cawley et al. | 427/77 |
| 3,622,322 | 11/1971 | Brill | 96/36.2 |

*Primary Examiner*—Cameron K. Weiffenbach
*Attorney, Agent, or Firm*—Melville, Strasser, Foster & Hoffman

[57] ABSTRACT

An improved photodelineatable cathode material is disclosed comprising a combination of triple carbonate (TC) and a hydrocarbon polymeric photoresist PR. A mixture of TC powder and PR is applied to a cathode by spraying, spinning or dipping and is then subjected to activation at a temperature from about 800° C up to the melting temperature. The cathodes can be activated at a temperature as low as 800° C and still deliver a 0-field, temperature-limited current density of 750 milliamperes per sq. centimeter at 600° C. If a pattern is desired, the coating is exposed through a suitable mask to actinic light to harden the photoresist in the desired areas. Following exposure, the exposed image areas are developed and the unexposed portions of the coating are removed with solvent. When dry, the cathode is ready for activation.

8 Claims, 3 Drawing Figures

LOW-TEMPERATURE THERMIONIC EMITTER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

This is a continuation of application Ser. No. 129,443 filed Mar. 30, 1971, now abandoned.

BACKGROUND OF THE INVENTION

1. Field of the Invention:

The present invention relates to thermionic cathodes and, more particularly, to improved materials and methods for preparing low-temperature, thermionic emitters.

2. Description of the Prior Art:

Contrary to the impression created by the manufacturers of solid state devices, the composition between solid state electron devices and vacuum devices has not been resolved. This is due in part to the fact that many operations such as those involving high frequency and high power can be performed only, or at least better in a vacuum device. The limitations of solid state devices and circuits in high temperature and high radiation ambients are well known.

Since many vacuum devices utilize thermionic emission, there is a continuous quest for improved emitters. The improvements usually sought are better efficiency and longer life without impairing the operation of the device. An emitter operating at temperatures lower than normal (~1,000° K or ~750° C) is more efficient in terms of power consumption and has increased life expectancy because the cathode material is being evaporated at a slower rate.

The present invention is concerned with a provision of an alkaline earth oxide coated emitters that operate at temperature in the vicinity of 600° C. Although evaporated BaO cathodes have been considered to have favorable characteristics, they do not perform as well as the commercially sprayed triple carbonate cathodes. Some sputtered triple carbonate cathodes have higher emission densities than sprayed cathodes, but reproducibility is poor and performance deteriorates with time. Moreover, these cathodes do not exhibit favorable current densities and life expectancies at reduced temperatures and it is difficult to apply a delineated pattern to the cathode substrate by the techniques utilized to apply and activate the alkaline earth oxide coatings.

SUMMARY OF THE INVENTION

Low-temperature thermionic emitters are prepared in accordance with the invention by forming a mixture of an alkaline earth oxide precursor and an actinically hardenable resin and applying a layer of the mixture to a conductive substrate. The layer of coating material is dried at low temperature and then raised to higher temperature to activate the emitter. The resin is preferably a diene resin hardenable by exposure to ultraviolet light and the precursor is suitably an alkaline earth carbonate, preferably a mixture of barium, strontium and calcium carbonates, known as triple carbonate (TC) which is transparent to ultraviolet radiation. The coating material can be selectively applied to the substrate by applying it in a selective pattern and hardening the pattern with the actinic radiation. In another technique, a surface of the substrate is completely covered with the coating material and the coating is selectively hardened by interposing a mask between the radiation source and the coated substrate during exposure and then removing the unexposed portions of the coating material.

The process of the invention reliably and repeatedly produces cathodes have 0-field, temperature-limited current densities of 750 milliamperes per sq. cm at operating temperatures of 600° C. This is a factor of 3 better than the typical emission obtained from commercially sprayed cathodes operating at the same temperature. Cathodes having substantially the same work function as those processed at much higher temperature are obtaind by activating the cathodes of the invention at temperatures of the order of 800° to 850° C. This is significant because at lower activation temperature, less of the alkaline earth metal and oxides are sublimed from the coating material.

These and many other attendant advantages of the invention will become apparent as the invention becomes better understood by reference to the following detailed description when considered in conjunction with the accompanying drawings.

DESCRIPTION OF THE PREFERRED EMBODIMENTS

Figure 1:
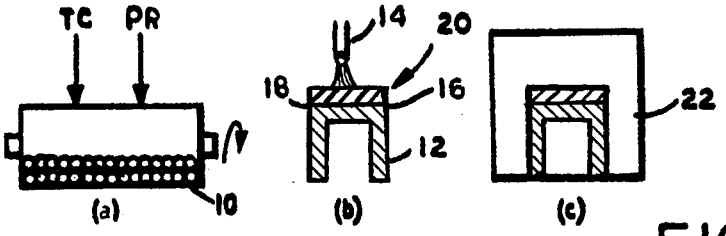
FIG. 1 is a schematic view of steps illustrating preparation of cathode substrates coated with the cathode material of the invention.

Cathode emitters are prepared according to the invention by coating a conductive substrate, preferably a cathode grade of nickel metal with an alkaline earth oxide precursor dispersed in an organic resin binder and drying and activating the coating to form an alkaline earth oxide coating. The alkaline earth oxide precursor is suitably a stable precursor thereof such as a carbonate which when heated, pyrolitically decomposes to form alkaline earth oxide usually mixed with some free alkaline earth metal while carbon oxide and oxygen gases are evolved.

The precursor preferably contains a substantial amount of barium carbonate. Though the precursor may consist essentially of barium carbonate, a preferred material is a mixture of barium strontium and calcium carbonates known as triple carbonate (TC). This material is available from many commercial sources and has a nominal composition by weight of 40–65% $BaCO_3$, 10–40% $SrCO_3$ and 5–20% $CaCO_3$.

The resin is preferably a photoresist type of resin. When a layer of the resin is selectively exposed to actinic radiation, portions harden and become insoluble in solvent while unexposed portions can be removed by solvent. The resin is preferably hardend by actinic radiation to which the alkaline earth metal oxide is transparent. The resin is preferably hardenable by ultraviolet radiation to which the triple carbonate is transparent. A suitable class of resins are polymers of conjugated diunsaturated hydrocarbons such as 1,3- dienes containing four to eight carbon atoms and most preferably, a polyisoprene containing a substantial amount of pendant external double bonds due to 3,4- addition polymerization. The pendant double bonds are more available for activation by the actinic energy to form free radicals for cross-linking the resin chain to adjacent chains.

The ratio by weight of triple carbonate to resin solids may be varied from 15% triple carbonate to about 75% triple carbonate without any marked increase in exposure time or loss in definition since the carbonates are relatively transparent to the long wave, near ultraviolet light used to expose and harden the PR binder. Excellent emissions are obtainable for all ratios. However, the ratio is preferably maintained between about 35 to 65% triple carbonate. Apparently, during activation the carbonates are converted to their oxides and the carbon residue from the resist reduces the barium oxide in the usual fashion, yielding free barium for activation of the layer and carbon monoxide. Some of the carbon monoxide escapes from the layer and is pumped out. Some of the carbon monoxide may combine, however, with free oxygen before leaving the layer yielding $CO_2$, which is subsequently pumped out. If too much carbon is present in the coating, the cathodes remain grey even after activation becoming whiter as the amount of resin is reduced. If too little carbon is present, incomplete activation could occur. At 72% triple carbonate, the cathodes appear snow white after activation.

Referring now to FIG. 1, the cathode coating material is prepared by intimately mixing a quantity of triple carbonate and photosensitive binder, such as KTFR (Kodak) in a ball mill 10. A solvent for the photoresist binder such as xylene is added to adjust the viscosity of the mixture to achieve proper mixing or milling and suitable coating application properties. A typical formulation for the coating material is as follows:

EXAMPLE I 6.6 grams of thinner, 3.3 grams of KTFR, photoresist and 4.8 grams of triple carbonate powder ($\sim\eta\%$ based on KTFR photoresist solids) were placed in a ball mill 10 and the mixture was ball milled for 48 hours to form an intimate dispersion of the powder in the photoresist binder. Other coatings were prepared containing lesser amounts of triple carbonate such as 4.0 grams of triple carbonate ($\sim$60% based on KTFR photoresist solids) by being subjected to the same treatment. The triple carbonate contained 56% $BaCO_3$, 31% $SrCO_3$ and 13% $CaCO_3$.

The ball mill should preferably be closed with a seal non-reactive with the TC-PR mixture. During a series of ball milling operations conducted with an aluminum foil seal, it was found that the mixture was contaminated with aluminum. Use of Teflon (polytetrafluoroethylene) seal is found to avoid this problem. Furthermore, superior emission properties of TC-PR cathodes are found when very long milling times over 10 hours and preferably at least 40 hours are used to prepare the TC-PR suspension. This tends to yield large surface areas for emission.

The ball milled mixture is coated onto a clean, cathode substrate 12 by spraying the mixture from nozzle 14 onto the top surface 16 of the cathode substrate to form a layer 18. The coated substrate 20 is then placed in an oven 22 and heated at 85° C for about 10 minutes to dry the layer 18.

Figure 2:
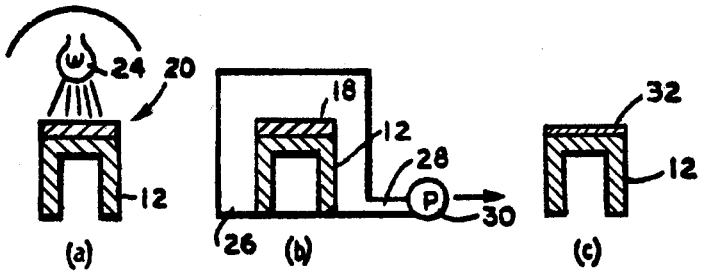
FIG. 2 is a schematic illustration of a first embodiment of preparing a coated cathode.

Referring now to FIG. 2, in a first procedure in accordance with the invention, the total layer 18 is hardened by exposure to an ultraviolet source 24 such as a mercury arc lamp for 5 minutes, and is then activated in a furnace 26 having an outlet 28 connected to a vacuum pump 30. During activation, the coated substrate is heated to a temperature of at least 800° C to pyrolitically decompose the binder and the carbonates to form an activated alkaline earth oxide coating 32, as shown in FIG. 2 (c).

Figure 3:
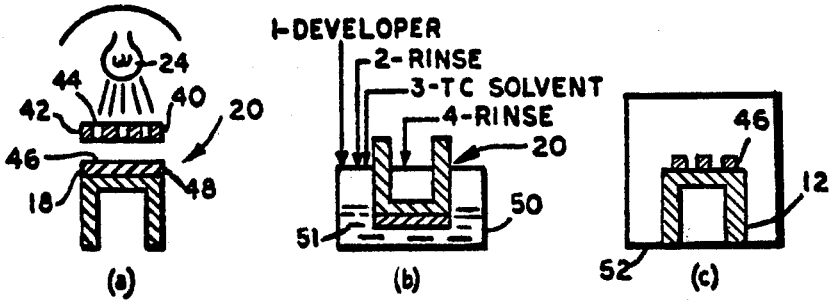
FIG. 3 is a schematic illustration of steps for forming a photodelineated cathode in accordance with the invention.
Figure 3:
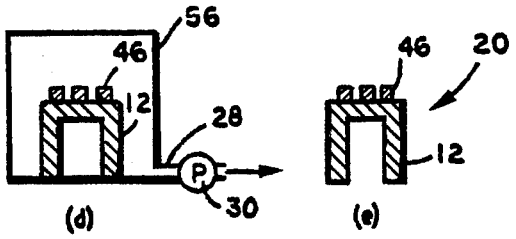

Referring now to FIG. 3, in an alternate procedure the dried and coated cathode 20 is removed from oven 22 and subjected to a pattern of ultraviolet radiation light by interposing a mask 40 between the ultraviolet radiation source 24 and the coated substrate 20. The mask has ultraviolet radiation opaque areas 42, and ultraviolet radiation transparent portions 44, suitably in the form of circular apertures. The radiation is selectively applied to layer 18 in the form of a dot pattern. The portions underlying the apertures 44 form selectively hardened portions 46. The remaining unexposed portions 48 are not hardened and cross-linked and remain soluble in a suitable solvent.

Following exposure, the hardened image is developed by dipping the coated cathode 20 for about 30 seconds in a tank 50 containing a KTFR photoresist developer 51, suitably a mixed hydrocarbon such as naphta which selectively removes the unexposed photoresist from the areas 48. The cathode substrate 20 is then subjected to a rinse such as water and the triple carbonate remaining on the unexposed areas 48 is removed by a short dip for about 30 seconds in a carbonate solvent such as 50% acetic acid followed by a water rinse. The substrate containing the hardened portions 46 is then dried in an oven 52 and activated in an oven 56, as described above, to form a cathode 20 containing a pattern of activated alkaline earth oxide dots 46 as shown in FIG. 3 (e).

A cathode containing 72% triple carbonate prepared according to the procedures of Example I and FIG. 1 and activated at 800° C had a thermionic work function of 1.18 eV and a Richardson constant of 5.0 amps/cm$^2$/° K$^2$. When the cathode was activated at 1,000° C, the thermionic work function was 1.24 eV and the Richardson constant was 1.3 amps/cm$^2$/° K$^2$. A cathode containing 60% TC prepared according to the same procedure and 800° C activation had a thermionic work function at 1.14 eV and a Richardson constant of 2.7 amps/cm$^2$/° K$^2$. Life tests were conducted to compare the cathodes prepared according to the invention to those prepared from evaporated BaO and sputtered TC. The results are reported in the following table.

TABLE I

LIFE TEST RESULTS

| Type of Cathode | Cathode Temp. (° C) | Current Density (milliamps/cm$^2$) Initial | Final | Life Test Time (hours) | Remarks |
|---|---|---|---|---|---|
| Evaporated BaO | 600 | 12.5 | 5.0 | 13,600 | 3600 hrs at $25 \times 10^{-3}$ amps/cm$^2$ at higher anode voltage |
| Evaporated BaO | 410 | 1.0 | 1.0 | 14,350 | continuing test |

TABLE I-continued

LIFE TEST RESULTS

| Type of Cathode | Cathode Temp. (° C) | Current Density (milliamps/cm²) Initial | Final | Life Test Time (hours) | Remarks |
|---|---|---|---|---|---|
| Sputtered TC | 600 | 37.5 | 24.5 | 2,500 | |
| Sputtered TC | 600 | 30 | 35 | 2,500 | |
| Sputtered TC | 600 | 80 | 100 | 2,500 | |
| TC-PR (72% TC) | 600 | 40 | 36.5 | 2,000 | continuing test |
| TC-PR (72% TC) | 600 | 37.5 | 30.0 | 2,000 | continuing test |

The work functions of the cathodes processed at low temperature (800° C) range from 1.01 eV to 1.14 eV and these values are not substantially lower than values obtained for cathodes activated at higher standard temperature of about 1000° C. The higher level of performance of TC-PR cathodes compared to conventional sprayed cathodes is clearly indicated. The life testing data gives no indication of degradation in performance.

To establish a basis for evaluating the cathodes, a diode was prepared having three sprayed triple carbonate cathodes prepared by RCA. The performance of each of the three cathodes was identical and exhibited a Richardson constant of 1.0 amps/cm²/° K² and a work function of 1.12 eV. These values are consistent with performance of industrial oxide cathodes. In relation to the superior emission properties of TC-PR cathodes, the following facts are believed to be significant. Conventional TC cathodes require heating to about 1050° C for activation. During activation, diffusion of a reducing impurity from the cathode substrate such as nickel to the alkaline earth oxide occurs. These impurities reduce the carbonate to Ba0. Free barium is believed to migrate over the surface of the oxide particles and some Ba0 sublimes from the surfaces.

All of these processes are temperature-dependent although the quantitative relationships are known. Successful conversion of conventional TC cathodes require the first three processes but not the last. Therefore, the time-temperature relation during activating of conventional cathodes is a compromise between the necessary first three processes and the last.

The TC-PR cathode of the invention is not believed to require diffusion of reducing impurity from the nickel substrate to the carbonate layer. In some experiments, conducted according to the invention the substrate was substituted with other metallic substrates with no effect on the emission properties. Furthermore, since some of the cathodes were activated at temperatures much lower than normal, this indicates that the diffusion process requires a much higher temperature than the other processes. Moreover, barium sublimation is slowed down by activating at lower temperatures than normal. This could more nearly yield a monomolecular layer of barium covering the cathode surface and higher Richardson constant values. Furthermore, elimination of a temperature dependent process reduces the severity of the time-temperature compromise problem during activation. Also the large quantity of organic material in the TC-PR cathodes that volatilize, contributes to the porosity of the coating, thereby enhancing the effective emitting area of the cathode.

According to a recent theory, the activation of oxide cathodes occurs due to reduction of the Ba0 and surface migration of free barium over the surfaces of the oxide crystallites to form an approximately monolayer coverage. This theory relies on surface doping rather than bulk doping mechanics. According to the band model, the Ba0 monolayer ionizes, partially yielding a surface dipole and band bending near the surface. A consequence of this model is that the electrical conductivity of oxide emitter layers is due to surface conductivity rather than bulk-conductivity. The highest emission levels are believed to originate from (Sr0)Ba or (SrCa0)Ba crystallites at the surface rather than (Ba0)Ba which is somewhat inferior.

In order for activation to occur, in ordinary TC sprayed cathodes, the reduction is effected through the agency of reducing impurities migrating by diffusion from the base nickel. In experiments conducted according to the invention in which the base metal was not cathode nickel and did not contain a reducing impurity, the emission characteristics obtained on these cathodes were virtually identical to the results obtained using CRT grade nickel with reducing impurities. Therefore, the reducing agent in the TC-PR cathodes is not the reducing impurity but is probably the carbon in the layer itself remaining after the organic photoresist has volatilized.

Another phenomena that occurs during activation is the migration of free barium over the surface of the crystallites causing activation and the rapid sublimation of Ba0 from the surface of the cathodes leaving only the Sr0 or SrCa0 particles at the surface which give higher emission than Ba0. Almost no sublimation of Sr0 or SrCa0 takes place because these materials have much lower vapor pressure than Ba0. Finally, sintering the oxide particles takes place during activation which contributes to mechanical integrity of the coating.

As further reasons for considering carbon as the reducing agent for the alkaline earth oxides in the process of the invention, the TC-PR cathodes turns black at a few hundred degrees Centrigrade. Ordinary sprayed TC cathodes contain 2 to 5% nitrocellulose binder. The carbon residue in this case causes a slight darkening of the coating at a few hundred degrees Centigrade. Apparently, after the carbonates are converted to their oxides, the carbon residue from the PR reduces Ba0 in the usual fashion, yielding free barium for activation and CO. Some of the CO escapes the layer and is pumped out. Some combines with free oxygen yielding $CO_2$ which is also pumped out. Since the amount of carbon influences the activation, it is reasonable that it is the active reducing agent in the coatings of the invention.

Low temperature thermionic emitters have several apparent advantages over their high temperature counterparts. Low temperature emitters reduce the heater power requirements and are therefore compatible with the need for battery or solar cell power sources in space vehicles. The prolonged life expectancy of an oxide cathode operating at 600° C should be 2 orders of magnitude greater than a similar cathode operating at 800° C. This is attractive for instrumentation in deep space probes and to extend the operational life of surveillance satellies. The cathodes would also have application for lower noise operation in the microwave beam type of tubes at both ends of a satellite-ground communication link, and particularly for low-noise traveling wave tubes designed for receiver input stages.

Another area of application forlow temperature emitters concerns coplanar vacuum devices or circuits for integrated vacuum circuits. Integrated vacuum circuits are of particular interest because of the combination of unique characteristics listed below:

1. The ability to operate at high ambient temperature (for example, 600° C);
2. The ability to withstand the nuclear radiation levels to which metal-ceramic vacuum tubes can be exposed;
3. Extreme physical and electrical ruggedness; and
4. A relatively high immunity to catastrophic failure in severe electromagnetic environments.

It is to be realized that only preferred embodiments of the invention have been described and that numerous substitutions, modifications and alterations are all permissible without departing from the spirit and scope of the invention as defined in the following claims.

What is claimed is:

1. A method of forming a low temperature thermionic emitter comprising the steps of:

a. forming a layer comprising a mixture of a pyrolitically decomposable alkaline earth oxide precursor dispersed in an actinically hardenable organic binder photoresist resin on the surface of a conductive substrate, said dispersion containing from 15% to 75% by weight of said precursor based on resin solids;

b. exposing said layer to actinic radiation to harden said binder; and c. heating said layer to a temperature sufficiently high to pyrolitically decompose said precursor and volatize said binder, said precursor being primarily reduced by the carbon remaining in said layer after said binder has volatized, to form a porous alkaline earth oxide containing coating on said surface.

2. A method according to claim 1 wherein said conductive substrate comprises a base metal free of reducing impurities.

3. A method according to claim 1 further including the step of selectively exposing portions of said layer to form a pattern of alkaline earth oxide on said surface.

4. A method according to claim 3 in which said step of selectively exposing said layer is effected by interposing a mask having radiation transparent apertures and radiation opaque areas between a radiation source and the layer during said exposing step to form selectively hardened portions of the layer underlying said apertures and non-hardened portions underlying said areas and further including the step of removing said non-hardened portions from said surface before said heating step.

5. A method according to claim 1 in which said binder is hardenable by actinic radiation over a band of frequencies to which said precursor is transparent and further including the steps of forming an intimate dispersion of said precursor in said binder and applying the dispersion to said surface to form said layer.

6. A method according to claim 5 in which said heating is conducted at a temperature of at least about 800° C.

7. A method according to claim 5 in which said precursor comprises a mixture of alkaline earth carbonates and said binder resin is a polymer of a $C_4$ to $C_8$ diene.

8. A method according to claim 7 in which said precursor comprises a mixture of barium, calcium and strontium carbonates, said resin is a polyisoprene and said dispersion contains from 35% to 65% by weight of carbonate based on resin solids.

* * * * *